US012016461B2

(12) United States Patent
Ha et al.

(10) Patent No.: US 12,016,461 B2
(45) Date of Patent: Jun. 25, 2024

(54) COMPACTLY PACKAGEABLE SOFA WITH A ZIPPERED FLAP BETWEEN THE SEAT CUSHION AND THE SEAT BACK

(71) Applicant: Zinus Inc., Gyeonggi-do (KR)

(72) Inventors: Jongwan Ha, Xiamen (CN); Youn Jae Lee, Gyeonggi-do (KR)

(73) Assignee: Zinus Inc., Tracy, CA (US)

( * ) Notice: Subject to any disclaimer, the term of this patent is extended or adjusted under 35 U.S.C. 154(b) by 655 days.

(21) Appl. No.: 17/185,988

(22) Filed: Feb. 26, 2021

(65) Prior Publication Data

US 2021/0274942 A1 Sep. 9, 2021

Related U.S. Application Data

(60) Provisional application No. 62/986,726, filed on Mar. 8, 2020.

(51) Int. Cl.
*A47C 4/02* (2006.01)
*A47C 17/02* (2006.01)
(Continued)

(52) U.S. Cl.
CPC ..... *A47C 17/02* (2013.01); *A47C 4/021* (2013.01); *A47C 4/028* (2013.01); *A47C 17/86* (2013.01); *A47C 31/023* (2013.01)

(58) Field of Classification Search
CPC ..... A47C 4/028; A47C 17/02; A47C 17/86; A47C 31/023; A47C 4/021
(Continued)

(56) References Cited

U.S. PATENT DOCUMENTS 2,571,574 A * 10/1951 Hicks ..... B60N 2/6054 297/182
2,771,127 A * 11/1956 Cole ..... A47C 7/622 297/182 X
(Continued)

FOREIGN PATENT DOCUMENTS

CN 202919636 U 5/2013
CN 203267838 U 11/2013
(Continued)

OTHER PUBLICATIONS

Office action of the Chinese Patent Office in the related Chinese patent application CN202010260158.8 dated Apr. 25, 2022 (11 pages).
(Continued)

*Primary Examiner* — Rodney B White
(74) *Attorney, Agent, or Firm* — Imperium Patent Works; Darien K. Wallace

(57) ABSTRACT

A compactly packageable sofa includes a seat back, a seat cushion, two arm panels and a zippered flap. In the assembled state of the sofa, the seat cushion and the seat back are held between the arm panels, and the zippered flap is attached to both the seat back and the seat cushion. The seat back does not contact the seat cushion in the assembled state of the sofa. In the compact state of the sofa, the seat back, the seat cushion and the arm panels are not attached to one another. Instead, the arm panels fit inside a compartment under the seat cushion. The flap is not attached to both the seat back and the seat cushion in the compact state of the sofa. In the compact state, the sofa is contained in a packing box whose width is only slightly greater than the depth of the seat cushion.

18 Claims, 14 Drawing Sheets

(51) Int. Cl.
*A47C 17/12* (2006.01)
*A47C 17/86* (2006.01)
*A47C 31/02* (2006.01)

(58) Field of Classification Search
USPC ..... 297/182
See application file for complete search history.

(56) References Cited

U.S. PATENT DOCUMENTS

| | | | | |
|---|---|---|---|---|
| 2,836,229 | A * | 5/1958 | Spetner | A47C 7/62 297/182 |
| 3,973,800 | A * | 8/1976 | Kogan | A47C 7/002 297/440.23 X |
| 4,365,840 | A * | 12/1982 | Kehl | A47C 4/02 297/440.22 |
| 5,161,854 | A * | 11/1992 | Yokoto | A47C 7/40 297/182 |
| 6,022,072 | A * | 2/2000 | Moyer | A47C 31/00 297/182 X |
| 6,241,317 | B1 * | 6/2001 | Wu | A47C 4/02 297/440.1 |
| 7,140,690 | B2 * | 11/2006 | White | A47C 4/03 297/440.14 |
| 8,974,139 | B2 * | 3/2015 | Saul | F16B 12/125 297/440.1 |
| 9,066,594 | B1 * | 6/2015 | Smith | A47C 3/00 |
| 10,980,348 | B2 * | 4/2021 | Policicchio | A47C 17/02 |
| 11,406,192 | B1 * | 8/2022 | Wu | A47C 7/42 |
| 11,457,742 | B1 * | 10/2022 | Zhang | A47C 4/02 |
| 2002/0103716 | A1 | 8/2002 | Wieland et al. | G06F 17/60 705/26 |
| 2004/0095000 | A1 * | 5/2004 | Durling | A47C 13/005 297/440.1 X |
| 2005/0138884 | A1 * | 6/2005 | White | A47C 4/02 52/633 |
| 2010/0148563 | A1 * | 6/2010 | Fera | A47C 17/86 297/463.1 |
| 2010/0270844 | A1 * | 10/2010 | Hood | A47C 7/42 297/440.15 |
| 2012/0212021 | A1 | 8/2012 | Hunter et al. | A47C 3/00 297/232 |
| 2013/0134763 | A1 | 5/2013 | Koch | A47C 17/02 |
| 2013/0320741 | A1 * | 12/2013 | Brandtner | F16B 12/22 297/440.1 |
| 2014/0130322 | A1 | 5/2014 | Helton | B68G 13/00 |
| 2016/0213155 | A1 | 7/2016 | Wang | A47C 17/04 |
| 2016/0249742 | A1 * | 9/2016 | Xie | A47C 4/028 297/440.23 |
| 2017/0071354 | A1 | 3/2017 | Mezzera | A47C 17/86 |
| 2017/0245644 | A1 * | 8/2017 | Lobel | A47C 7/021 |
| 2017/0347799 | A1 | 12/2017 | Sewell et al. | A47C 4/02 |
| 2018/0213943 | A1 | 8/2018 | Kuhl et al. | A47C 13/00 |
| 2019/0090646 | A1 | 3/2019 | Adams | A47C 7/42 |
| 2019/0350372 | A1 | 11/2019 | Hirschhaut | A47C 17/175 |
| 2020/0121090 | A1 * | 4/2020 | Romano | A47C 17/86 |
| 2020/0375362 | A1 * | 12/2020 | Hale | A47C 17/04 |
| 2021/0068547 | A1 * | 3/2021 | Hodgson | A47C 7/42 |
| 2022/0104622 | A1 * | 4/2022 | Chen | A47C 7/546 |
| 2022/0104623 | A1 * | 4/2022 | Bridgman | A47C 4/02 |

FOREIGN PATENT DOCUMENTS

| | | | |
|---|---|---|---|
| CN | 204232684 | U | 4/2015 |
| CN | 204393923 | U | 6/2015 |
| CN | 204743347 | U | 11/2015 |
| CN | 107638003 | A | 1/2018 |
| CN | 208447967 | U | 2/2019 |
| CN | 208807957 | U | 5/2019 |
| CN | 209252181 | U | 8/2019 |
| CN | 209391499 | U | 9/2019 |
| CN | 212465471 | U | 2/2021 |
| GB | 2571789 | A | 9/2019 |

OTHER PUBLICATIONS

Office action of the Chinese Patent Office in the related Chinese patent application CN202010260158.8 dated Sep. 1, 2022 (8 pages).

* cited by examiner

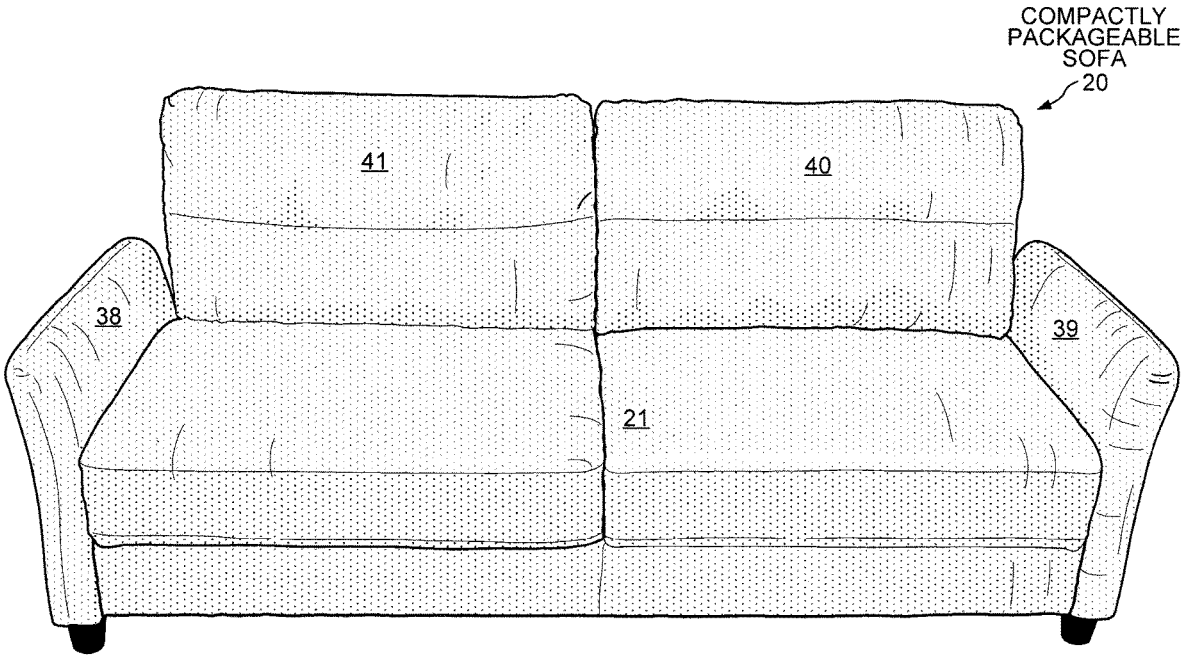
FIG. 18
FIG. 19
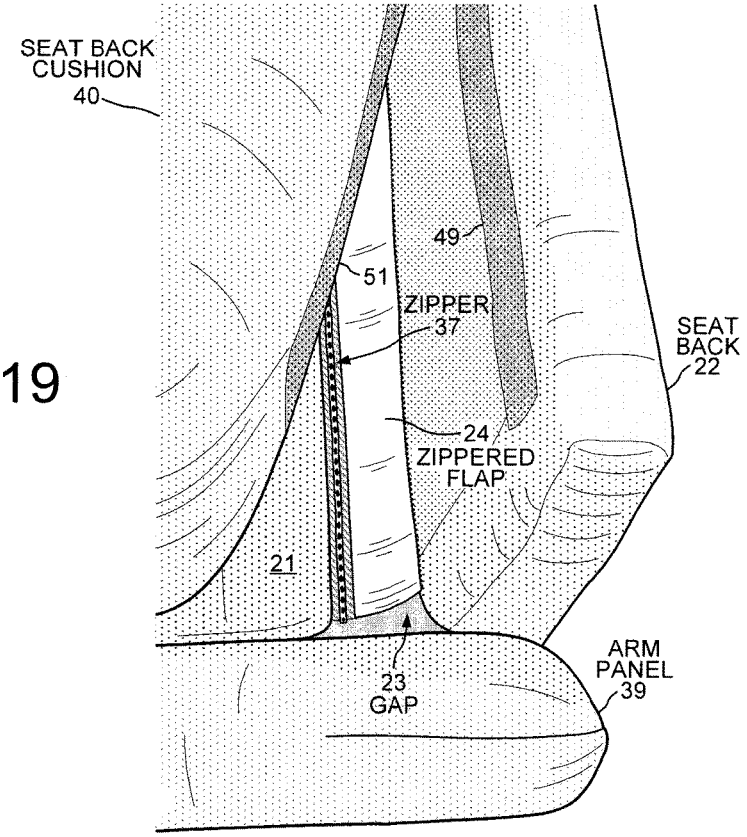

COMPACTLY PACKAGEABLE SOFA WITH A ZIPPERED FLAP BETWEEN THE SEAT CUSHION AND THE SEAT BACK

CROSS REFERENCE TO RELATED APPLICATIONS

This application claims priority under 35 U.S.C. § 119 from U.S. Provisional Application No. 62/986,726, entitled "Zippered Flap Between Seat Cushion and Seat Back Allows Sofa to be Packaged in a Smaller Box," filed on Mar. 8, 2020, the subject matter of which is incorporated herein by reference.

TECHNICAL FIELD

The described embodiments relate to packaging for furniture, and more particularly to a zippered fabric flap that enables a sofa to be packaged in a smaller shipping box.

BACKGROUND INFORMATION

Due to the bulkiness of upholstered furniture, such as sofas, loveseats and upholstered platform beds, the cost of transportation and storage in the supply chain from the factory to the end customer is a significant component of the overall price of the furniture. Any incremental cost of transportation due to the furniture's larger size is compounded if the furniture must be shipped across an ocean from its place of manufacture to the market where the furniture is sold. For furniture sold through online marketplaces that must be delivered to the home of each online customer, transportation and delivery is an even larger component in the overall cost of the goods. To facilitate transportation and storage, the furniture is shipped in a disassembled state that occupies a smaller volume than the assembled furniture. The furniture is designed so that the disassembled components can be compactly packed into a smaller container. A method is sought for saving even more space in the transportation and storage of the furniture that can further lower the cost of delivering the furniture to the retail customer.

SUMMARY

A compactly packageable sofa includes a seat back, a seat cushion, two arm panels, seat back cushions and a zippered flap. In the assembled state of the sofa, the seat cushion and the seat back are held between the arm panels, and the zippered flap is attached to both the seat back and the seat cushion. The seat back cushions are disposed above the zippered flap in the assembled state. The seat back does not contact the seat cushion in the assembled state of the sofa, and a gap exists between the seat cushion and the seat back. In the compact state of the sofa, the seat back, the seat cushion and the arm panels are not attached to one another. Instead, the arm panels and the seat back cushions fit inside a compartment under the seat cushion. The flap is not attached to both the seat back and the seat cushion in the compact state of the sofa. In the compact state, the sofa is contained in a single packing box whose width is no more than four inches greater than the depth of the seat cushion.

In another embodiment, a sofa or loveseat includes a seat back, a seat cushion, an arm rest and a flap. In the assembled state of the sofa, the seat back and the seat cushion are attached to the arm rest. In a compact state of the sofa, the seat back, the seat cushion and the arm rest are not attached to one another. In the compact state, all of the components of the sofa are disposed in a single packing box, and the arm rest is contained in a compartment under the seat cushion. The height of the seat back, the depth of the seat cushion and the height of the arm rest are approximately equal. The flap is attached to both the seat back and the seat cushion in the assembled state. The flap is not attached to both the seat back and the seat cushion in the compact state. A gap exists between the seat cushion and the seat back in the assembled state, and the flap covers the gap in the assembled state. In a first embodiment, a zipper attaches the flap to the seat cushion in the assembled state. In the first embodiment, the flap is not attached to the seat cushion in the compact state.

The arm rest includes an attachment slot, and the seat back includes a wedge insert. In the assembled state, the seat back is supported by the arm rest by the wedge insert being inserted into the attachment slot. In the assembled state, the arm rest stands on two legs. In the compact state, the legs are not attached to the arm rest but are stored in the compartment under the seat cushion.

Further details and embodiments are described in the detailed description below. This summary does not purport to define the invention. The invention is defined by the claims.

BRIEF DESCRIPTION OF THE DRAWINGS

The accompanying drawings, where like numerals indicate like components, illustrate embodiments of the invention.

FIG. 18 is a perspective view of the novel sofa in a completely assembled state.

FIG. 19 is a partial top view of the assembled sofa of FIG. 18 in which a seat back cushion has been pulled away from the seat back to reveal the zippered flap.

DETAILED DESCRIPTION

Figure 1:
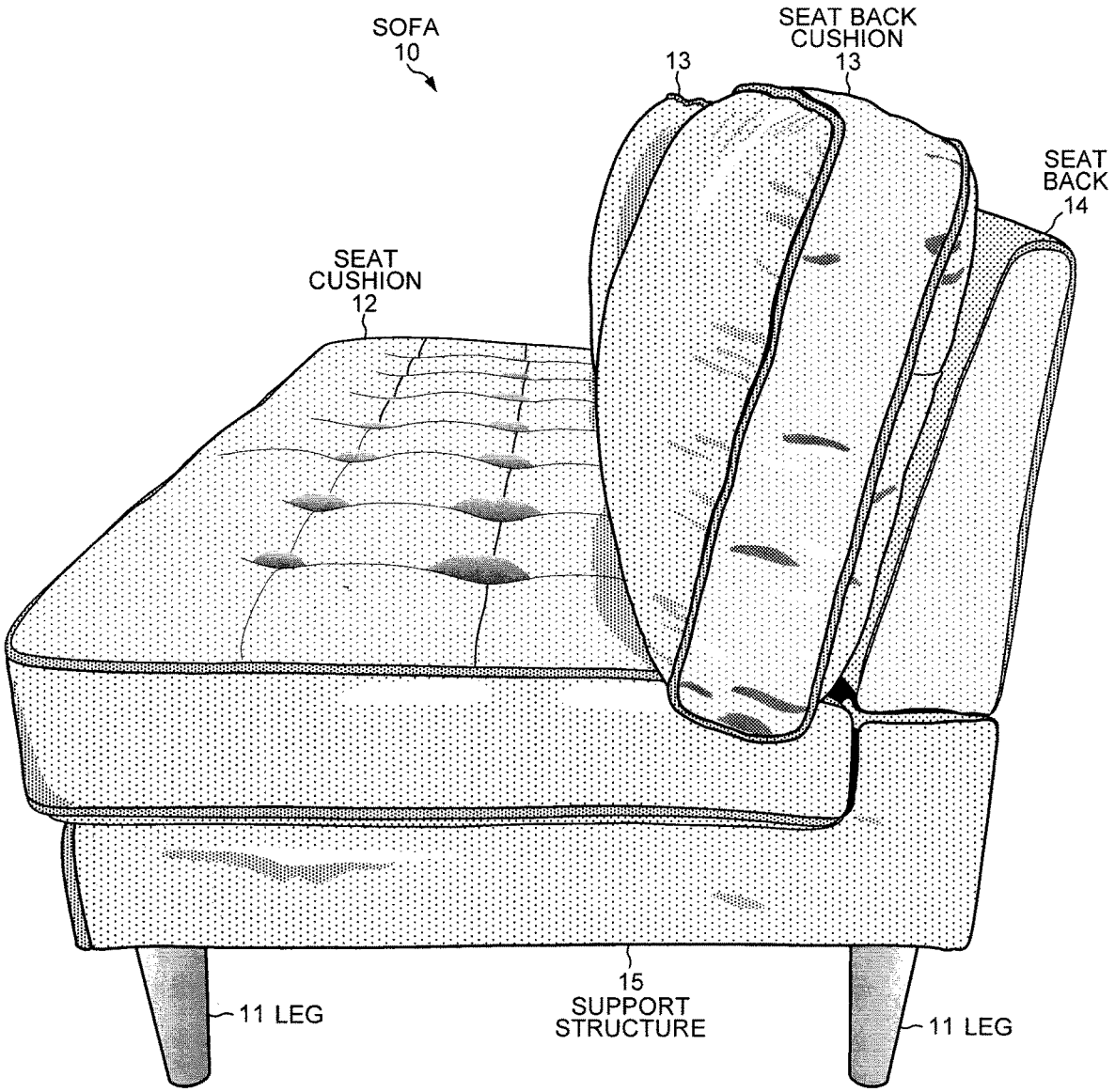
(PRIOR ART) FIG. 1
FIG. 1 (prior art) is a perspective side view of a conventional sofa.

FIG. 1 (prior art) is a side view of a conventional armless sofa 10 with legs 11. A sofa without armrests is chosen so that the relative dimensions of the seat cushion and seat back are readily apparent. The relative dimensions of the parts of the sofa determine the smallest size packing box into which the sofa will fit. When transporting the sofa to market, the higher shipping rates charged by freight forwarders and trucking companies can be avoided if the sofa can be made to fit in a packing box whose dimensions are small enough to qualify for the standard rates of courier ground services, such as Federal Express, UPS, DHL, etc. The package sizes that qualify for the standard shipping rates of courier ground services are often defined by the sum of the length, width and height of the packing box. The sum of these dimensions for the same shipped volume of furniture is greater for a flat, wide box than for a box whose cross section approaches a square. When shipping a sofa, the length of the packing box can be reduced only by reducing the length of the support structure for the seat cushion, which is typically a single piece that spans between the legs. However, reducing the length of the support structure is not an option if a longer sofa is being sold. Furthermore, decreasing the sum of the width and height of the box permits the length of the box to be longer while allowing the sum of the length, width and height of the box to remain within the maximum sum of dimensions that qualifies for the shipping rates of courier ground services. The inventors have recognized that this permits longer sofas to be sold online and delivered to customers using courier ground services.

Conventional sofa 10 can only be shipped in a packing box that is relatively wide and flat because of the large depth of the seat cushion 12. One reason that seat cushion 12 is so deep is that the seat back cushions 13 must rest on the top of seat cushion 12. For sofa 10 of FIG. 1, for example, this reduces the available seating depth on seat cushion 12 to only about two thirds of the top surface of the seat cushion. About one third of seat cushion 12 is being used to support the seat back cushions 13 instead of being used as a surface for seating.

It is evident from FIG. 1 that seat cushion 12 has a depth which is much greater than the height of the seat back 14. So the longer dimension of the end of the packing box is required to accommodate seat cushion 12 as opposed to seat back 14. Even if the lower support structure 15 of the conventional sofa 10 were modified and shortened to support only seat cushion 12, the packing box for sofa 10 would still have to be wide enough to accommodate the depth of seat cushion 12.

Figure 2:
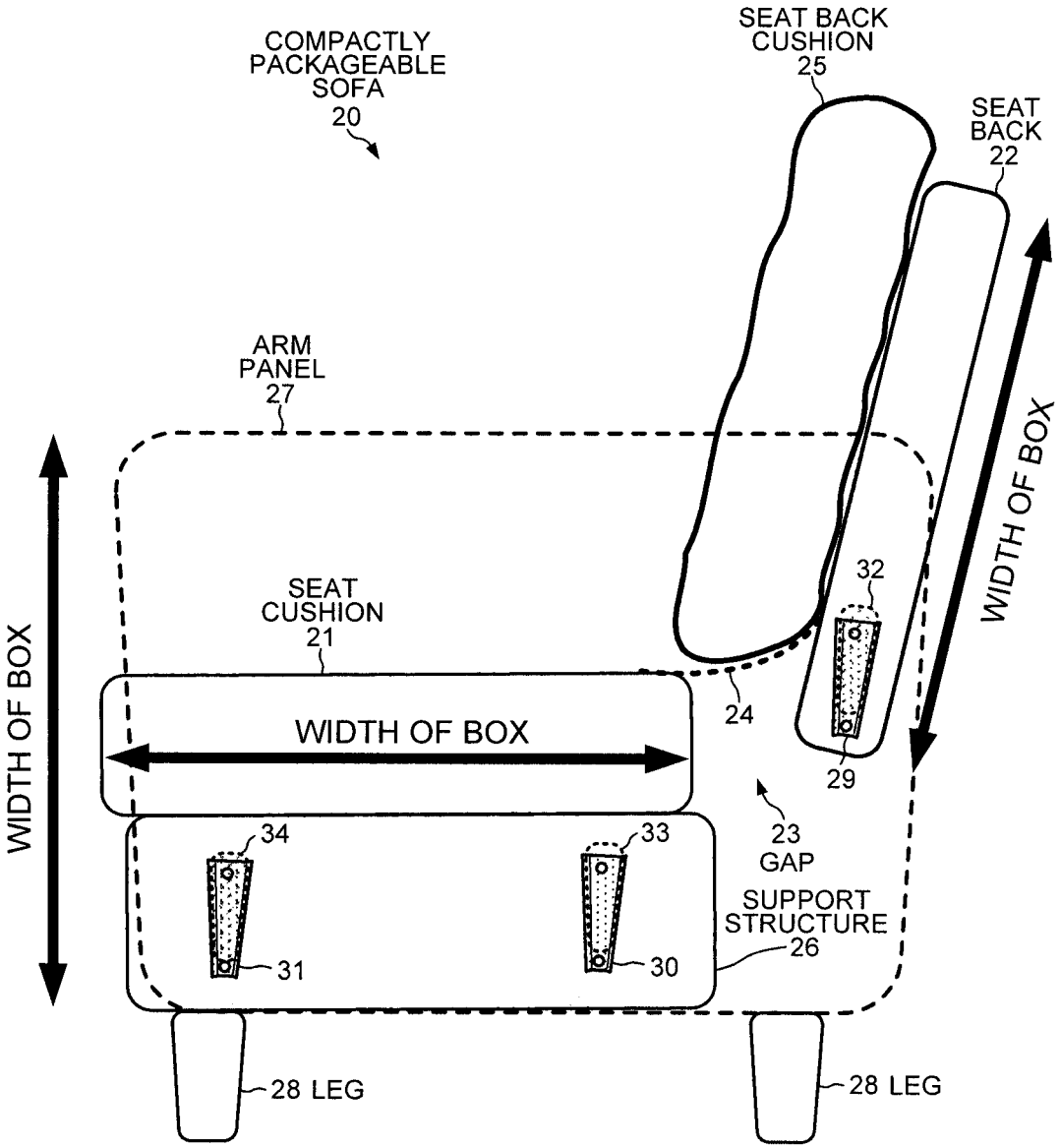
FIG. 2 is a cross sectional side view of a novel sofa with a zippered flap between the seat cushion and the seat back.

FIG. 2 shows upholstered furniture in the form of a novel, compactly packageable sofa 20. Sofa 20 can fit in a smaller packing box than can conventional sofa 10 because the depth of the seat cushion 21 is smaller and does not extend all the way to the seat back 22. In the assembled state of sofa 20, there is a gap 23 between seat cushion 21 and seat back 22 that is covered by a zippered flap 24. The seat back cushion 25 sits over the zippered flap 24 and rests against seat back 22. Using zippered flap 24 to support seat back cushion 25 allows the depth of seat cushion 21 to be reduced to the length that is used as a surface for seating. In turn, the width of the packing box into which the components of sofa 20 must fit in the compact state can be reduced to the depth of seat cushion 21. In addition, the additional amount of foam or other support material at the back of the seat cushion 21 that would otherwise be used to support the seat back cushions 40-41 is saved and not used in the design of sofa 20.

Seat cushion 21 is supported by a bottom support structure 26. In one embodiment, seat cushion 21 is integrally attached to bottom support structure 26 and remains a single piece even in the compact state of sofa 20 in the packing box. For example, seat cushion 21 can be formed as upholstery affixed over the top of bottom support structure 26. The upholstery can include layers of foam, such as high density foam or polyurethane memory foam. Seat back cushion 25 can also include foam.

In the assembled state of sofa 20, seat cushion 21 and seat back 22 are supported on either side by arm panels 27. Plastic or wooden legs 28 screw into the bottom of each arm panel 27. Connectors are attached to the inner side of each arm panel 27 and connect to corresponding connectors on seat back 22 and support structure 26. In one embodiment, the connectors are wedges on seat back 22 and support structure 26 that fit into slots on arm panels 27. FIG. 2 shows three attachment slots 29-31 disposed on the inner side of arm panel 27. A wedge insert 32 on seat back 22 is shown fitting into attachment slot 29 on arm panel 27. A corresponding wedge insert and attachment slot connect seat back 22 to the opposite arm panel, which is not shown in FIG. 2. Wedge inserts 33-34 on bottom support structure 26 fit into attachment slots 30-31 on arm panel 27. Corresponding wedge inserts and attachment slots connect support structure 26 to the opposite arm panel.

In one embodiment, the two seat back cushions 25 and that two arm panels 27 are accommodated within bottom support structure 26 in the compact state of sofa 20. The height of the arm panels 27 and seat back 22 is set slightly smaller than the depth of seat cushion 21 so that the arm panels and seat back fit inside support structure 26. More storage volume within support structure 26 can be achieved by forming support structure 26 and seat cushion 21 as a unitary structure by placing cushioning over the top of support structure 26. This permits the arm panels and seat back cushions to fit inside the compartment of support structure 26 and reduces the required height of the shipping box. The legs 28 can also be stored in the support structure 26 for shipping.

FIGS. 3-19 illustrate how compactly packageable sofa 20 is contained in a packing box 35 that can be shipped using courier ground services and how sofa 20 is assembled after being removed from the packing box.

Figure 3:
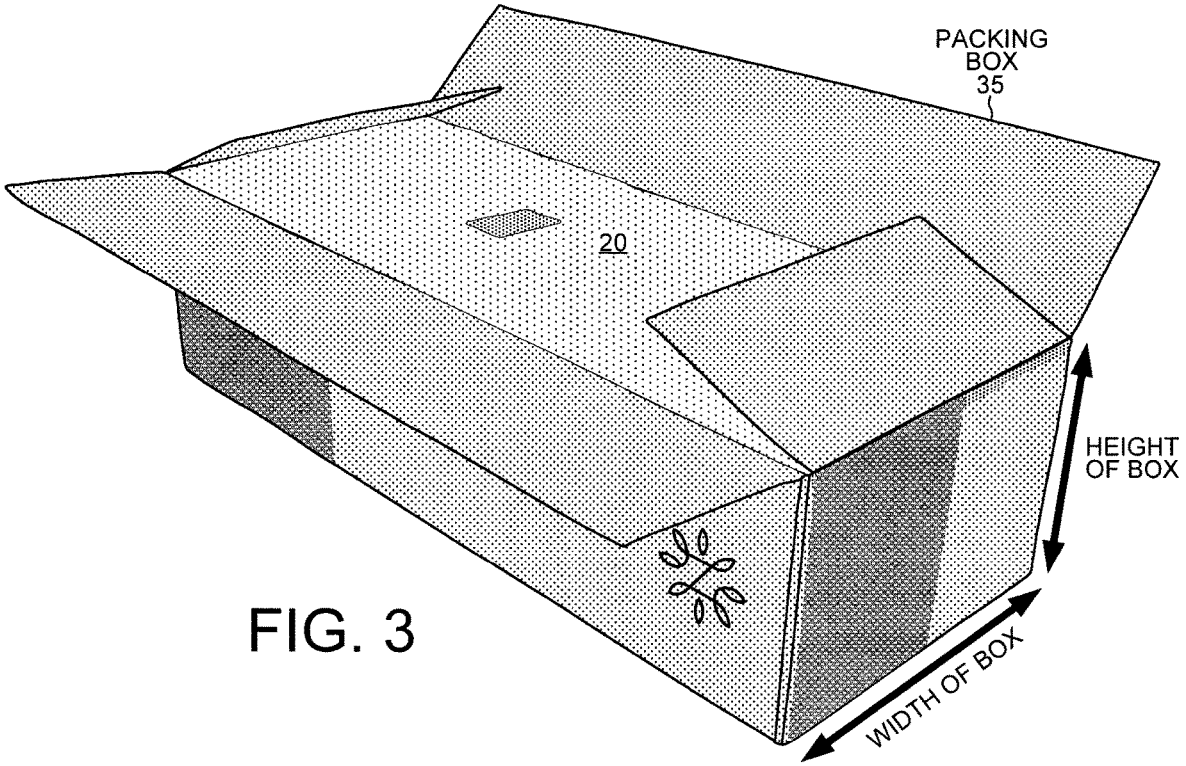
FIG. 3 shows the novel sofa in a compact state packaged in packing box.

FIG. 3 shows sofa 20 in the compact state packaged in packing box 35. The components of sofa 20 are wrapped in sheets of plastic and bubble wrap. Substantially all of the volume of packing box 35 is occupied by the components of sofa 20, and there are no significant areas inside the box that are filled just with padding. Packing box 20 is made of cardboard and has dimensions small enough to qualify for the standard rates of courier ground services. For example, the sum of the length, width and height of box 35 is no more than 165 inches.

Figure 4:
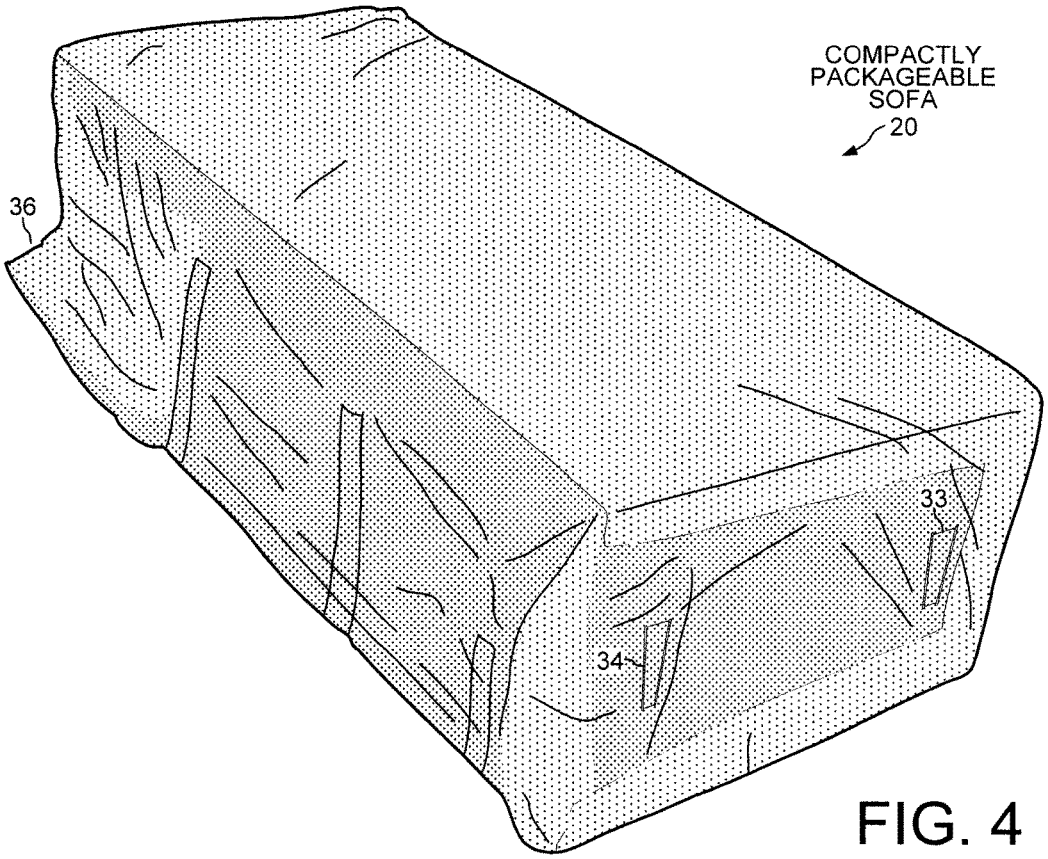
FIG. 4 shows the components of the novel sofa in the compact state after a user first removes them from the packing box.

FIG. 4 shows the components of sofa 20 in the compact state removed from packing box 35. The components of sofa 20 are wrapped in plastic sheets 36. The outlines of wedge inserts 33-34 on bottom support structure 26 are visible through the plastic sheets 36.

Figure 5:
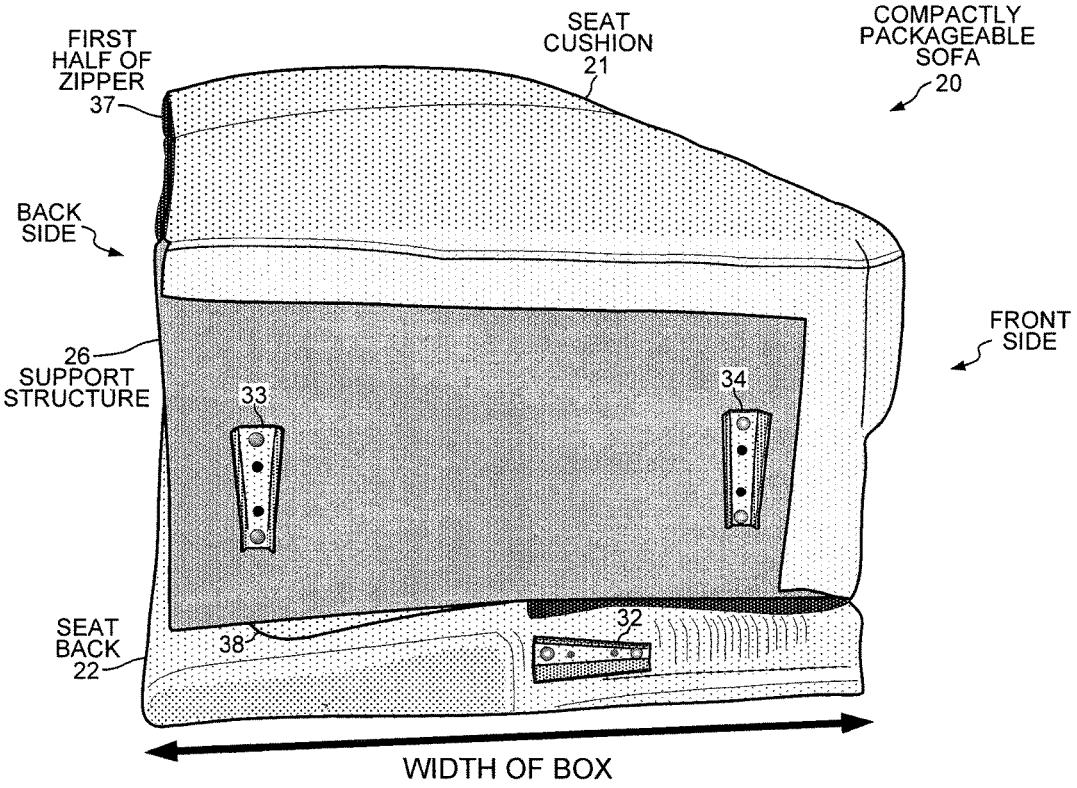
FIG. 5 is an end view of the sofa components of FIG. 4 with the bubble wrap and plastic sheets removed.

FIG. 5 is an end view of the components of sofa 20 from FIG. 4 with the bubble wrap and sheets of plastic 36 removed. FIG. 5 shows that bottom support structure 26 is stacked over seat back 22 in the compact state in packing box 35. The long dimension of seat back 22 is about the same length as the depth of seat cushion 21 and support structure 26. The width of packing box 35 is only slightly larger than the depth of seat cushion 21 and the height of seat back 22. In one embodiment, the width of the packing box 35 is no more than four inches greater than the depth of seat cushion 21.

In this embodiment, seat cushion 21 is integrally attached to bottom support structure 26 and forms a unitary structure. Cushioning is attached over the top of support structure 26 to form seat cushion 21. FIG. 5 shows a first half of the zipper 37 that zips into a second half of the zipper on the zippered flap 24. The first half of the zipper 37 is attached to the back of the seat cushion 21. Support structure 26 is a hollow shell in which the arm panels and seat back cushions are stored in the compact state inside packing box 35. In FIG. 5, a small portion of an arm panel 38 is visible protruding out from under support structure 26 and resting on seat back 22. FIG. 5 shows wedge inserts 33-34 attached to one end of bottom support structure 26. Wedge insert 32 is attached to an end of seat back 22.

Figure 6:
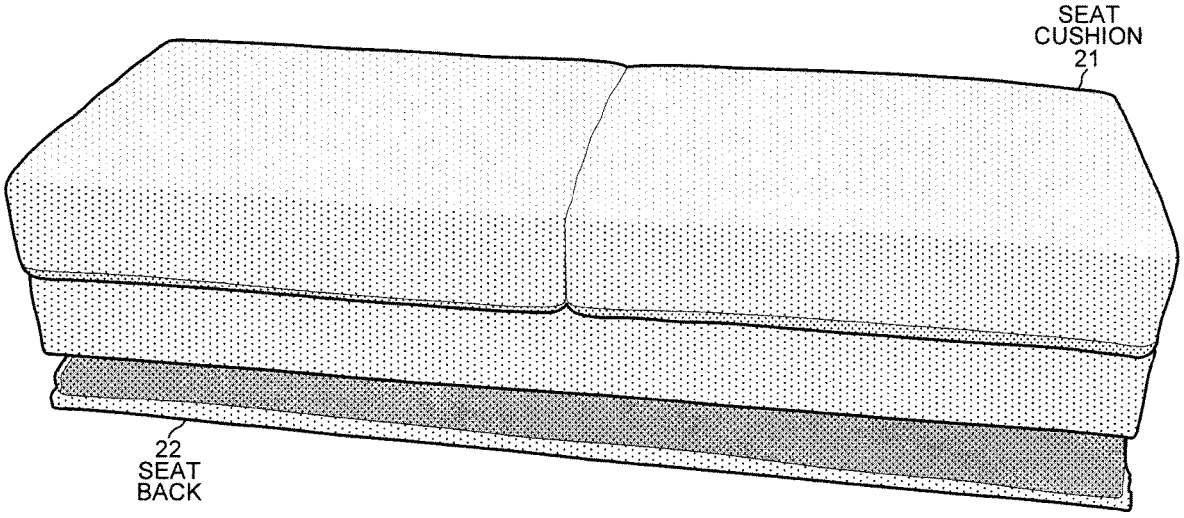
FIG. 6 shows the sofa components of FIG. 5 viewed from the front side.

FIG. 6 shows the components of sofa 20 of FIG. 5 viewed from the front side. The bottom inner side of seat back 22 is visible under the combined seat cushion 21 and support structure 26. The arm panels and seat back cushions contained inside support structure 26 are not visible in FIG. 6.

Figure 7:
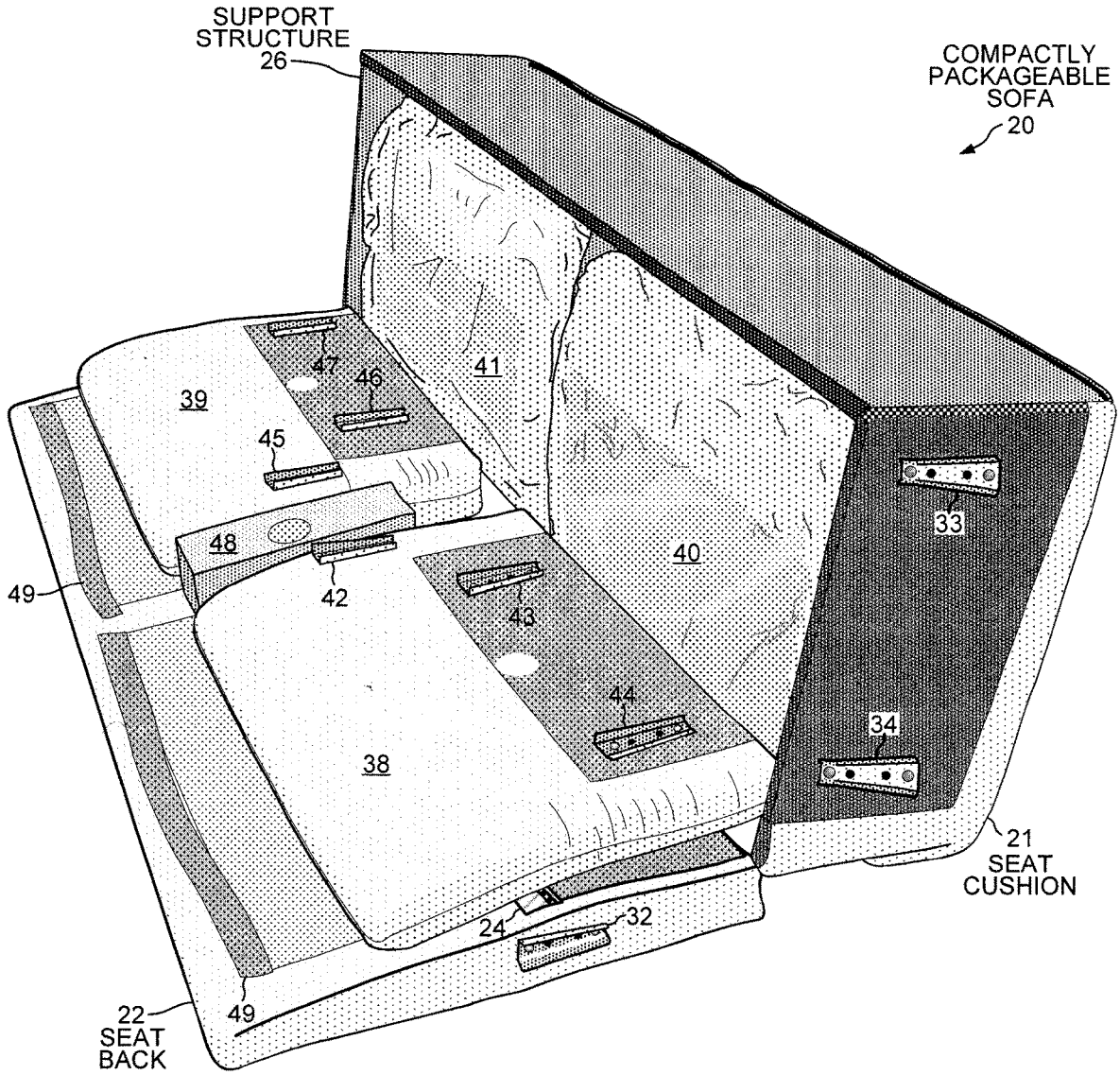
FIG. 7 shows the sofa components of FIG. 5 after the bottom support structure has been rolled to the side revealing the arm panels and seat back cushions that were contained inside.

FIG. 7 shows the components of sofa 20 of FIG. 6 after the combined cushion 21/structure 26 has been rolled to the side revealing arm panels 38-39 and seat back cushions 40-41 that were contained inside. The seat back cushions 40-41 are still contained in clear plastic bags for shipping in FIG. 7. Arm panel 38 includes attachment slots 42-44 on its inner side, and arm panel 39 includes attachment slots 45-47 on its inner side. In the assembled state, wedge inserts 33-34 on support structure 26 slide down into attachment slots 43-44 on arm panel 38. Wedge insert 32 on seat back 22 slides down into attachment slot 42 on arm panel 38. Two additional wedge inserts are disposed on the opposite side of support structure 26, and an additional wedge insert is disposed on the opposite side of seat back 22. But these additional wedge inserts are not visible in FIG. 7.

A small cardboard box 48 is shown between the arm panels 38-39. Box 48 contains the four legs 28 that are screwed into the bottom sides of the arm panels 38-39 in the assembled state of sofa 20. In the assembled state when sofa 20 is in use, legs 28 are the only components of the sofa that touch the floor. Strips 49 of hook and loop fastening material, such as Velcro®, are attached to the front side of seat back 22 and are used to hold the seat back cushions 40-41 in place against the seat back. One end of zippered flap 24 is visible in FIG. 7 protruding out from under arm panel 38. The upper edge of zippered flap 24 is sewn onto the front side of seat back 22. The second half of the zipper 37 runs along the lower edge of zippered flap 24. In the assembled state, the second half of the zipper 37 on zippered flap 24 connects with the first half of the zipper 37 that is sewn into the back of seat cushion 21.

Figure 8:
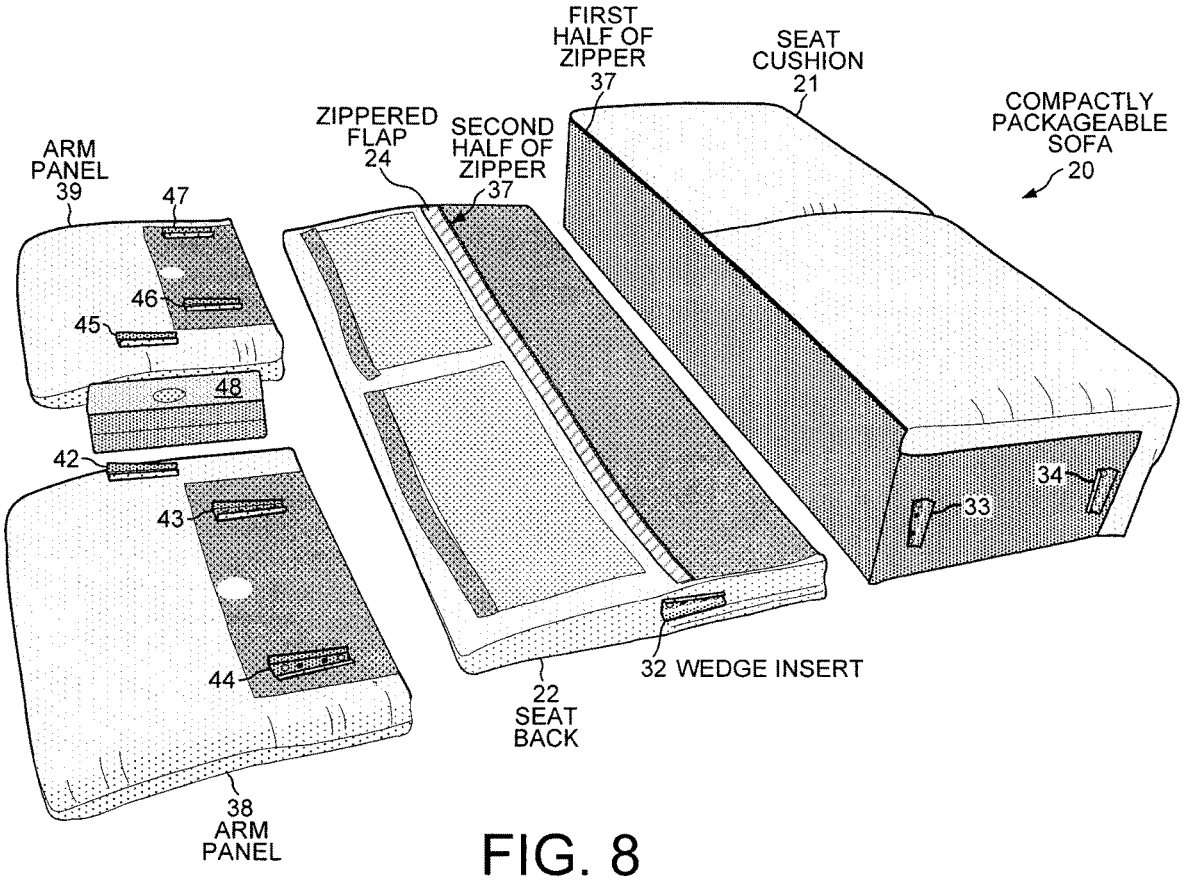
FIG. 8 shows the components of the novel sofa laid out for assembly with the arm panels and seat back cushions removed from the compartment in the bottom support structure.

FIG. 8 shows the components of sofa 20 laid out for assembly. The seat back cushions 40-41 have been removed from the compartment of the support structure 26, where they were stored in FIG. 7. The legs 28 are still contained in box 48. Two legs 28 must be screwed into the bottom of arm panel 38, and the other two legs 28 must be screwed into the bottom of arm panel 39. FIG. 8 shows the fabric zippered flap 24, whose upper edge is sewn into the front side of seat back 22. The second half of the zipper 37 is disposed on the loose, lower edge of the zippered flap 24. FIG. 8 also shows the first half of the zipper 37 that is sewn into the back of the seat cushion 21.

Figure 9:
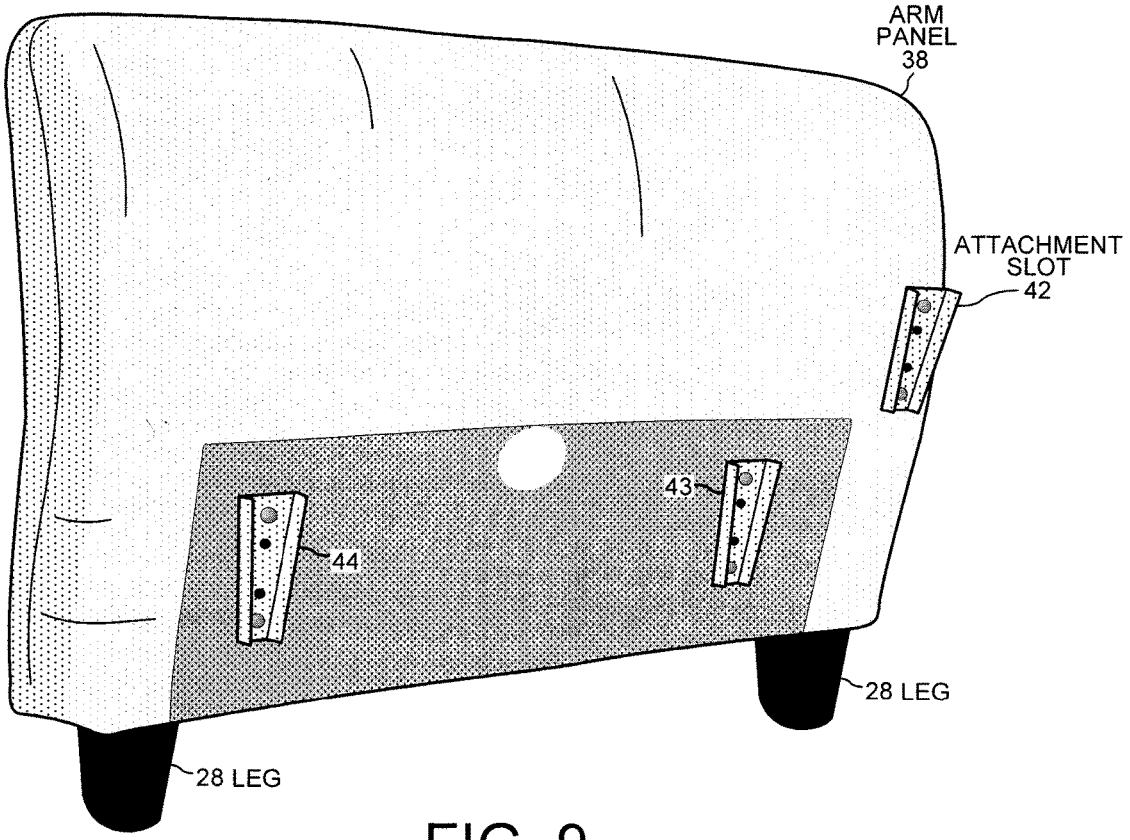
FIG. 9 is a more detailed view of an arm panel with three attachment slots attached to the inner side of the arm panel.

FIG. 9 is a more detailed view of arm panel 38. Two legs 28 have been screwed into the bottom of arm panel 38. The three attachment slots 42-44 are screwed onto the inner side of arm panel 38. During assembly of sofa 20, support structure 26 is lowered between the upright arm panels 38-39 so that the wedge inserts 33-34 on support structure 26 are inserted down into the attachment slots 43-44 and wedge into the slots.

Figure 10:
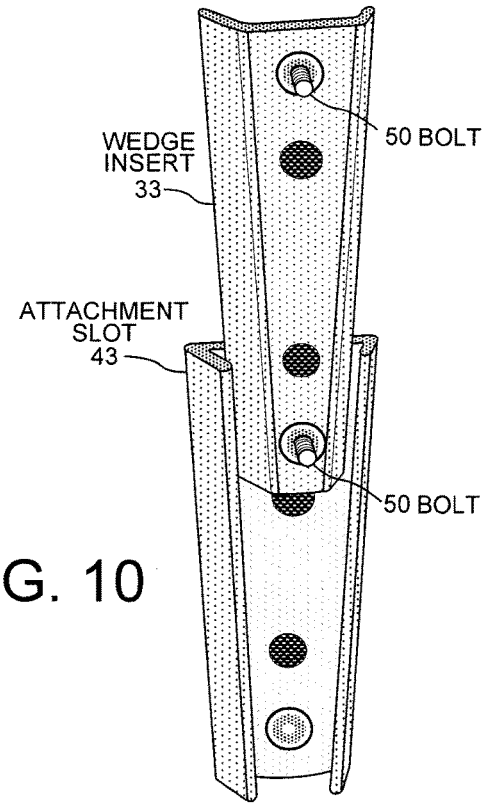
FIG. 10 is a more detailed schematic view of a wedge insert being inserted down into an attachment slot.

FIG. 10 is a more detailed schematic view of wedge insert 33 sliding down into attachment slot 43. Both the wedge inserts and the attachment slots are made by bending sheet metal. To make the attachment slots, the long sides of a rectangular metal plate are bent inwards past right angles such that the wings of the attachment slots are directed inwards. To make the wedge inserts, the long sides of a narrower rectangular metal plate are also bent. But the bending is stopped before the sides reach right angles to the center strip of the wedge insert. In the schematic view of FIG. 10, attachment slot 43 would be connected to arm panel 38 by being screwed into the plane of the page. Wedge insert 33 would be connected to support structure 26 by being screwed towards the viewer and away from the plane of the page. FIG. 10 shows the ends of the bolts 50 that would be screwed into a side of the support structure 26.

Figure 11:
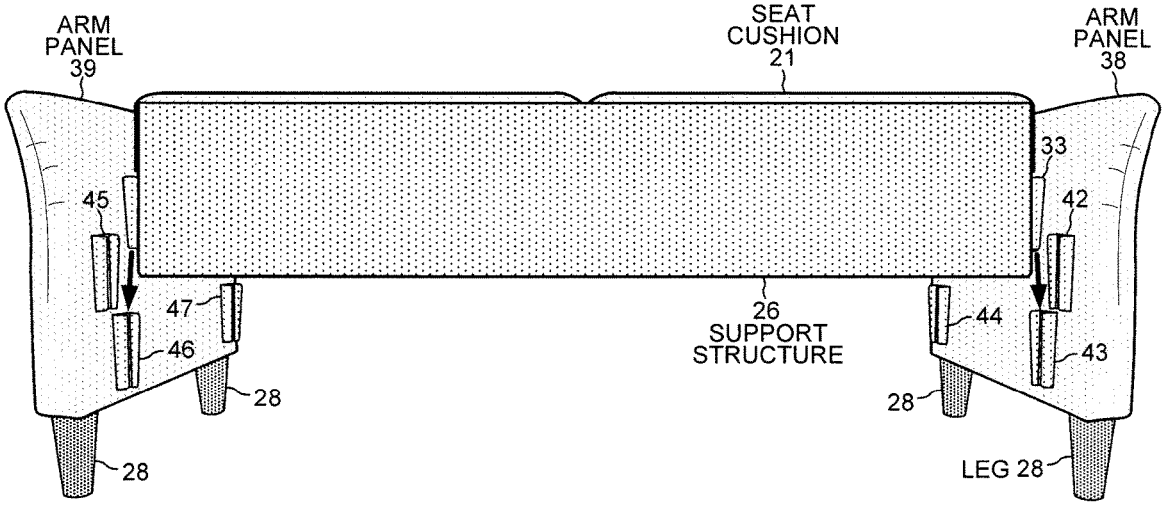
FIG. 11 illustrates the assembly step of the novel sofa in which the bottom support structure is lowered between the upright arm panels so that wedge inserts on the bottom support structure slide down into attachment slots on the arm panels.

FIG. 11 illustrates the assembly step of sofa 20 in which support structure 26 is lowered between the upright arm panels 38-39 so that four wedge inserts on support structure 26 are inserted down into two attachment slots on arm panel 38 and two attachment slots on arm panel 39. For example, the wedge inserts 33-34 on support structure 26 are inserted down into the attachment slots 43-44 on arm panel 38. An arrow illustrates wedge insert 33 being inserted into attachment slot 43.

Figure 12:
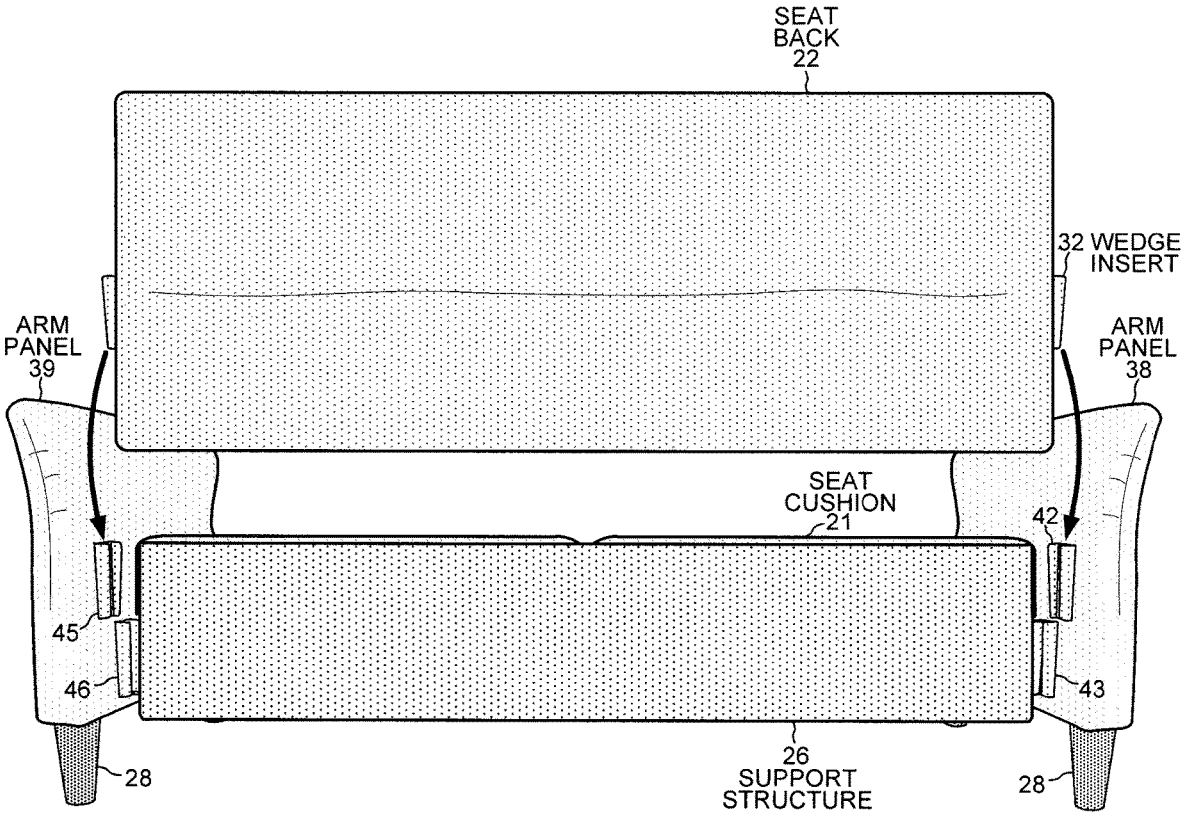
FIG. 12 illustrates the next assembly step of the novel sofa in which the seat back is lowered between the arm panels so that wedge inserts on the seat back slide down into attachment slots on the arm panels.

FIG. 12 illustrates the next assembly step of sofa 20 in which seat back 22 is lowered between the upright arm panels 38-39 so that two wedge inserts on seat back 22 are inserted down into one attachment slot on arm panel 38 and another attachment slot on arm panel 39. For example, an arrow illustrates wedge insert 32 on seat back 22 being inserted into attachment slot 42 on arm panel 38.

Figure 13:
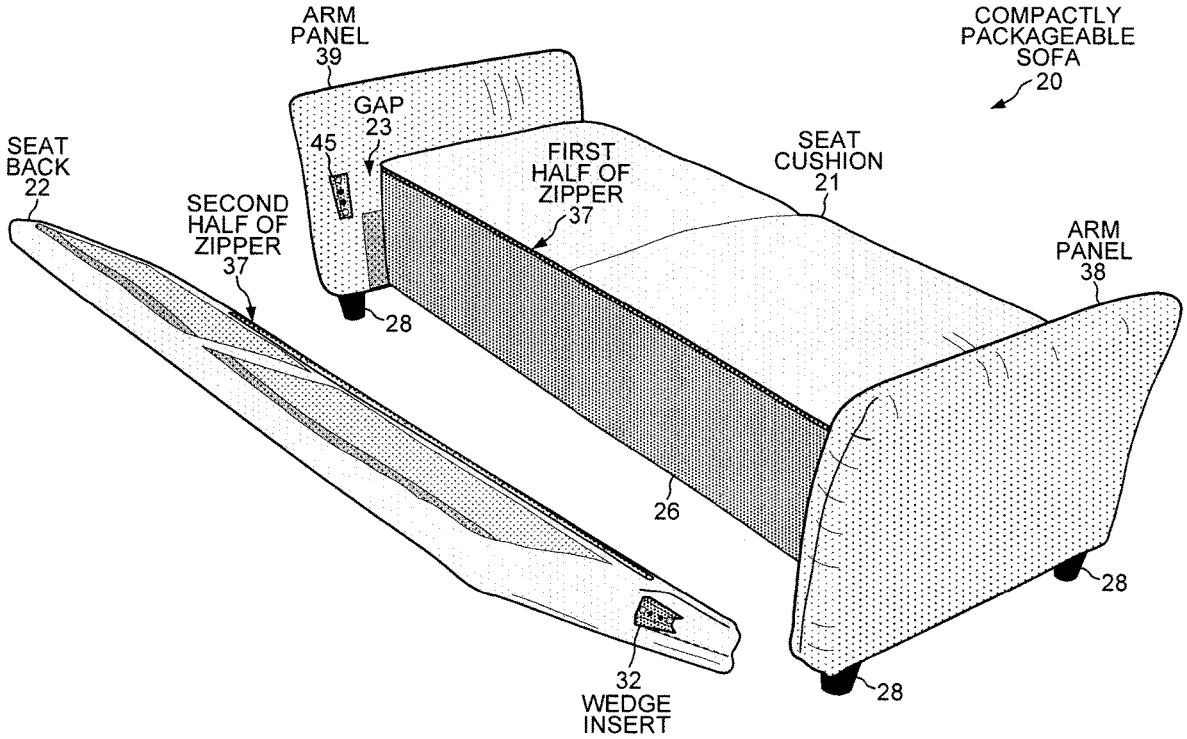
FIG. 13 is a perspective view of the novel sofa during the assembly step of FIG. 12.

FIG. 13 is a perspective view of sofa 20 during the assembly step of FIG. 12. Seat back 22 is being lifted up so that its two wedge inserts can be inserted into an attachment slot on arm panel 38 and into another attachment slot on arm panel 39. FIG. 13 shows the first half of the zipper 37 that is sewn into the back of the seat cushion 21, and the second half of the zipper 37 that is disposed on the loose, lower edge of the zippered flap 24 on seat back 22. An arrow in FIG. 13 points to where the gap 23 will be between seat cushion 21 and seat back 22 after the seat back is attached to the two arm panels 38-39.

Figure 14:
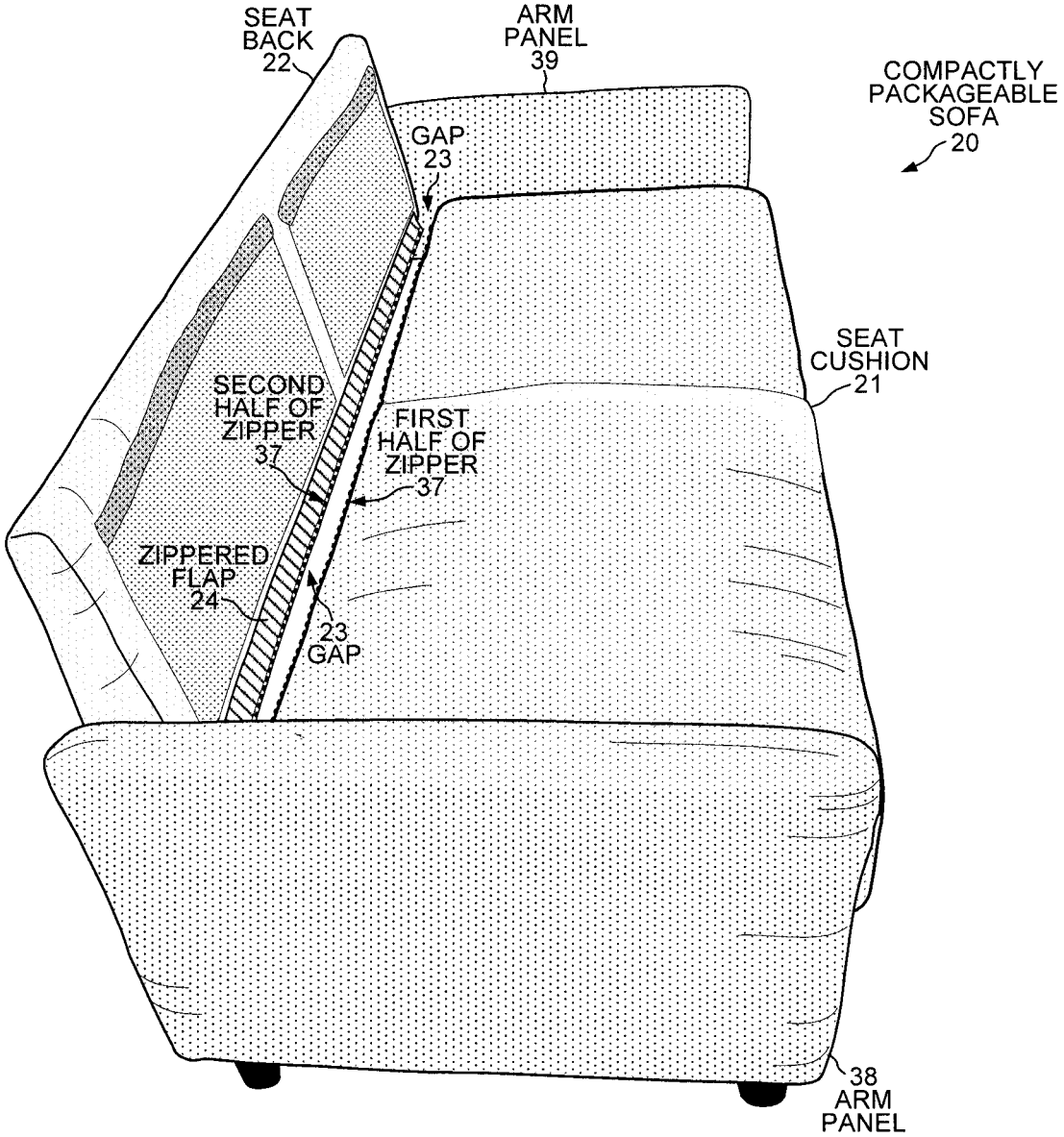
FIG. 14 is a side perspective view of the novel sofa after the seat back has been attached to the two arm panels showing the gap between the seat cushion and the seat back.

FIG. 14 shows sofa 20 after seat back 22 has been attached to the two arm panels 38-39. The gap 23 is apparent between seat cushion 21 and seat back 22. The first half of zipper 37 on seat cushion 21 has not yet been connected to the second half of zipper 37 on zippered flap 24, which is attached to seat back 22.

Figure 15:
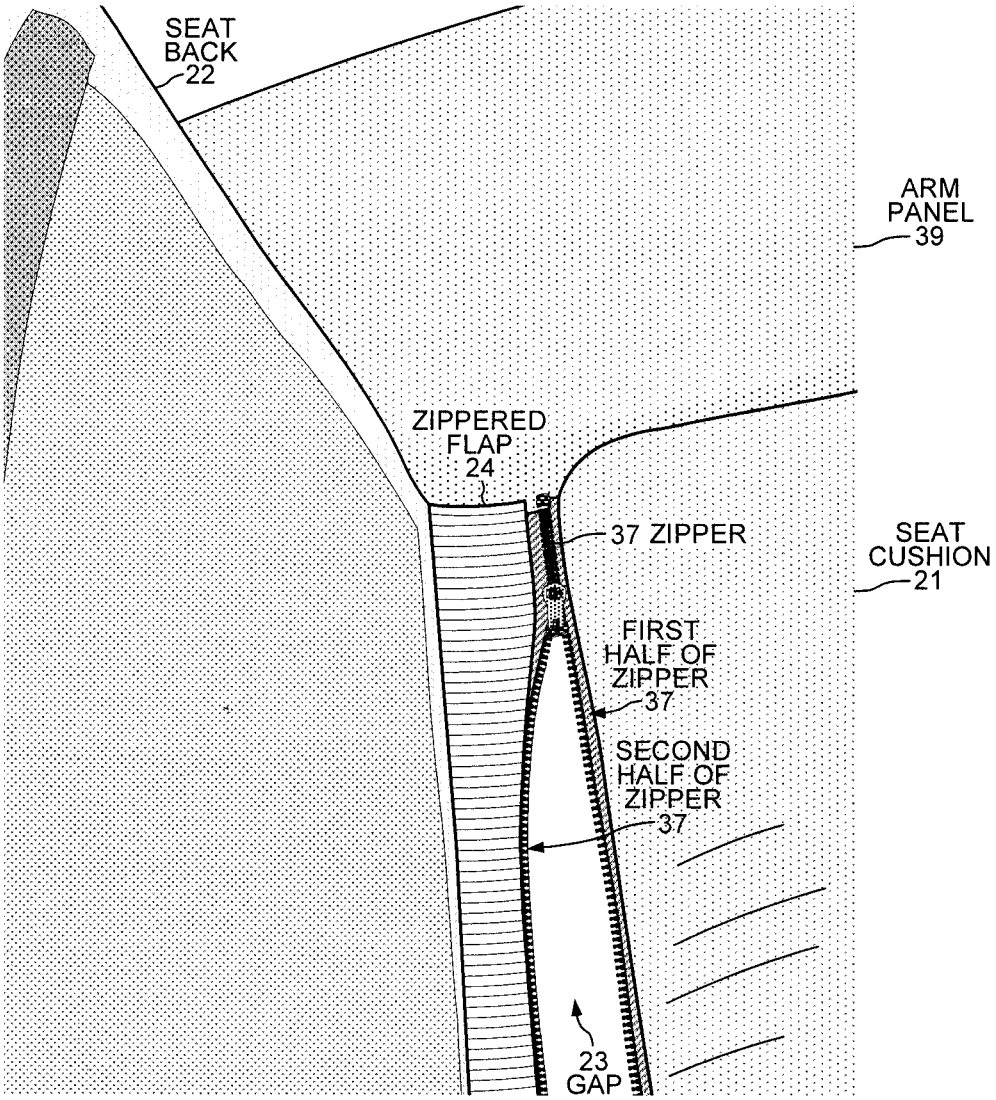
FIG. 15 illustrates the assembly step in which the two halves of a zipper are zipped together to connect the zippered flap between the seat cushion and the seat back.

FIG. 15 illustrates the next step in the assembly of sofa 20 in which the two halves of zipper 37 are zipped together, which connects zippered flap 24 between seat cushion 21 and seat back 22 and thereby covers gap 23.

Figure 16:
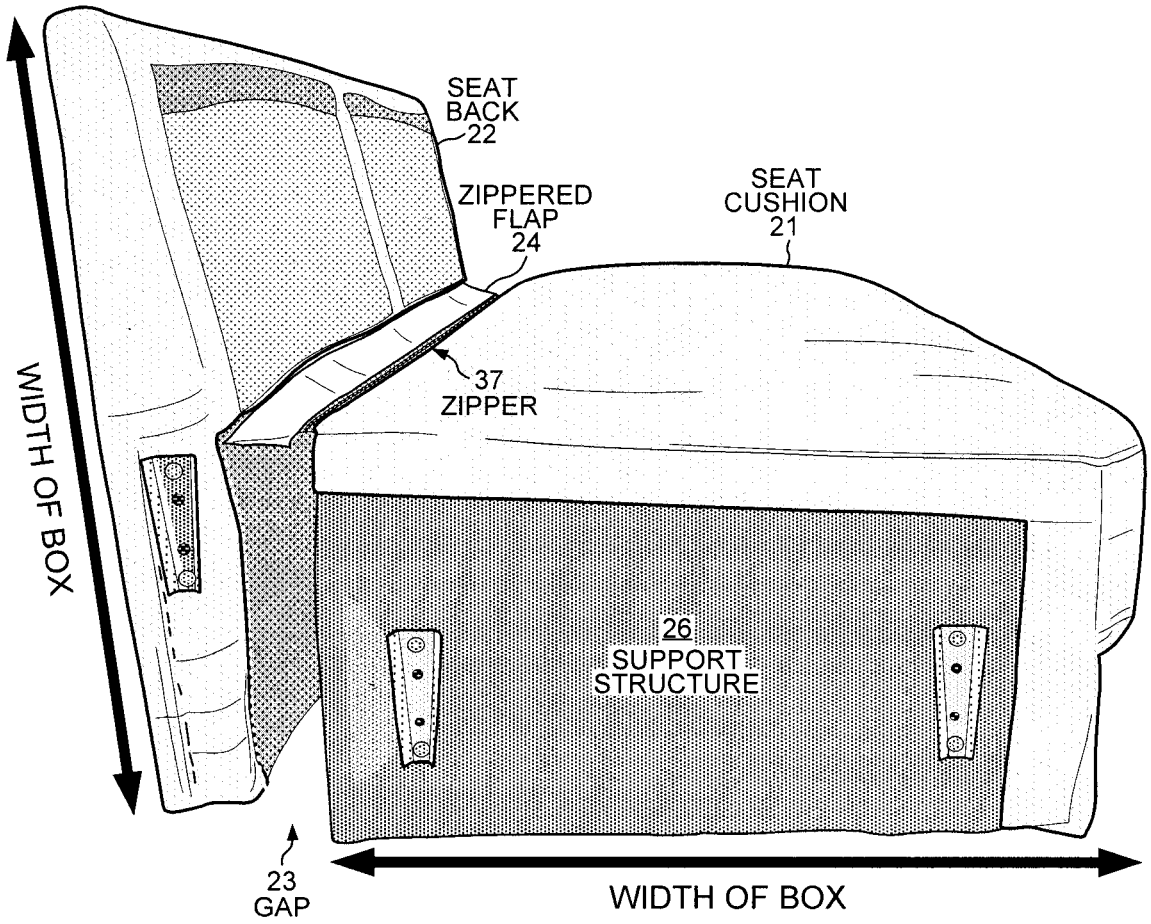
FIG. 16 is a cutaway view of just the seat back and seat cushion without any arm panels after completing the assembly step of FIG. 15.

FIG. 16 is a cutaway view of only seat back 22 and the combined cushion 21/structure 26 without any arm panels after completing the step of FIG. 15 in which zipper 37 has connected zippered flap 24 between seat back 22 and seat cushion 21. FIG. 16 shows the gap 23 between seat back 22 and bottom support structure 26 that is covered by zippered flap 24. By covering gap 23 with flap 24, the width of the combined cushion 21/structure 26 can be decreased by the width of the gap while maintaining a continuous surface from the front of seat cushion 21 to the seat back 22. Despite the shorter depth of seat cushion 21, the seat depth is still acceptable for the user of sofa 20 because the seat back cushions 40-41 prevent the user from sitting on flap 24. Flap 24 provides a support on which the seat back cushions 40-41 can rest and also prevents objects from falling into the gap, such as objects that fall out of a user's pocket. In addition, by decreasing the width of the combined cushion 21/structure 26 and by designing the seat back 22 and arm panels 38-39 to have heights equal to the reduced width of the seat cushion 21, the width of the packing box 35 can be correspondingly reduced. The width of the packing box need be only slightly greater than the depth of seat cushion 21 in order to accommodate all of the components of sofa 20.

Figure 17:
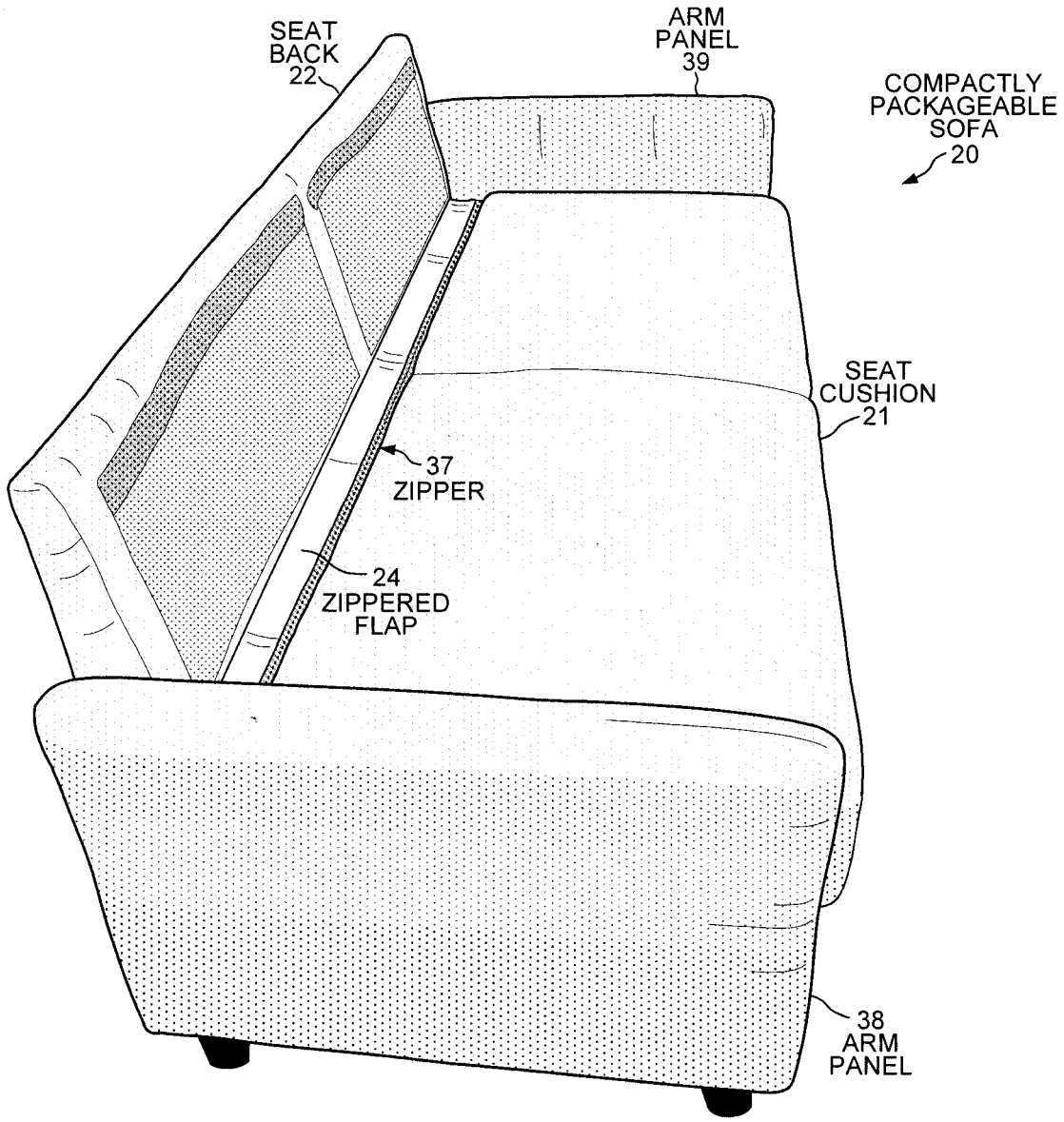
FIG. 17 is a view of the novel sofa similar to that of FIG. 14 except that the two halves of the zipper have been zipped together to connect the zippered flap to the seat cushion.

FIG. 17 is a view of sofa 20 similar to that of FIG. 14 except that the first half of zipper 37 on seat cushion 21 has now been connected to the second half of zipper 37 on zippered flap 24. Zippered flap 24 is now pulled tight across gap 23 between seat back 22 and seat cushion 21. In the embodiment of FIG. 17, zipper 37 attaches flap 24 to the back edge of seat cushion 21. In another embodiment, zipper 37 is sewn to seat back 22 and attaches flap 24 to seat back 22. The edge of flap 24 opposite zipper 37 is sewn to the back edge of seat cushion 21. In yet another embodiment, zipper 37 runs down the middle of flap 24 such that there are two halves of the flap that are joined by the zipper. One half of the flap is sewn to seat back 22, and the other half of the flap is sewn to the back edge of seat cushion 21.

FIG. 18 shows compactly packageable sofa 20 in the assembled state. The seat back cushions 40-41 have been placed over zippered flap 24 and rest against seat back 22. Zippered flap 24 is covered by seat back cushions 40-41 and is not visible to the user of sofa 20. Sofa 20 is a full-sized sofa in its assembled state. In its compact state, sofa 20 fits within the maximum size limitations that qualify for the standard rates of courier ground services and is thus deliverable to customers of online marketplaces. Sofa 20 is able to fit within a smaller packing box because the zippered flap 24 allows the width of seat cushion 21 to be reduced.

FIG. 19 is a partial top view of the assembled sofa 20 of FIG. 18 in which seat back cushion 40 has been pulled away from seat back 22 to reveal zippered flap 24. A small portion of gap 23 is visible in FIG. 19 below flap 24 near arm panel 39. A Velcro strip 51 is shown on the back of seat back cushion 40, which sticks to Velcro strip 49 on seat back 22 and keeps cushion 40 in place over flap 24.

Although certain specific embodiments are described above for instructional purposes, the teachings of this patent document have general applicability and are not limited to the specific embodiments described above. Accordingly, various modifications, adaptations, and combinations of various features of the described embodiments can be practiced without departing from the scope of the invention as set forth in the claims.

What is claimed is:

1. A sofa comprising:

a seat back;

a seat cushion;

a first arm panel, wherein in an assembled state of the sofa the seat back and the seat cushion are attached to the first arm panel; and a flap that is attached to both the seat back and the seat cushion in the assembled state of the sofa, wherein the seat back, the seat cushion, and the first arm panel are not attached to one another in a compact state of the sofa, and wherein the flap is not attached to both the seat back and the seat cushion in the compact state of the sofa, wherein in the assembled state a gap exists between a back edge of the seat cushion and a front side of the seat back, and wherein in the assembled state the flap extends substantially horizontally from an upper back edge of the seat cushion over the gap to the front side of the seat back and covers the gap below.

2. The sofa of claim 1, wherein the seat back does not contact the seat cushion in the assembled state of the sofa.

3. The sofa of claim 1, further comprising:

a zipper that attaches the flap to the seat cushion in the assembled state of the sofa, wherein the flap is not attached to the seat cushion in the compact state of the sofa.

4. The sofa of claim 1, further comprising:

a zipper that attaches the flap to the seat back in the assembled state of the sofa, wherein the flap is not attached to the seat back in the compact state of the sofa.

5. The sofa of claim 1, wherein the seat back has a height, wherein the seat cushion has a depth, wherein the first arm panel has a height, and wherein the height of the seat back, the depth of the seat cushion and the height of the first arm panel are approximately equal.

6. The sofa of claim 5, wherein the sofa is contained in a packing box in the compact state, and wherein the packing box has a width that is slightly greater than the depth of the seat cushion.

7. The sofa of claim 1, wherein the seat cushion has a length, a depth and a height, wherein the sofa is contained in a packing box in the compact state, wherein the packing box has a length, a width and a height, and wherein the width of the packing box is no more than four inches greater than the depth of the seat cushion.

8. The sofa of claim 1, wherein in the compact state of the sofa the seat back, the seat cushion, and the first arm panel are contained in a single packing box.

9. The sofa of claim 1, wherein the first arm panel includes a first attachment slot, wherein the seat back includes a first wedge insert, and wherein in the assembled state of the sofa the seat back is supported by the first arm panel by the first wedge insert being inserted into the first attachment slot.

10. The sofa of claim 1, further comprising:

a second arm panel, wherein in the assembled state of the sofa the seat back and the seat cushion are attached to the second arm panel;

first legs that are attached to the first arm panel in the assembled state; and second legs that are attached to the second arm panel in the assembled state, wherein the first legs are not attached to the first arm panel in the compact state, and the second legs are not attached to the second arm panel in the compact state.

11. The sofa of claim 1, further comprising:

a seat back cushion, wherein the seat back cushion is disposed above the flap in the assembled state.

12. A boxed sofa comprising:

a seat cushion;

a first arm panel;

a second arm panel;

a seat back;

a seat back cushion;

a flap that is attached to the seat back; and a single packing box, wherein in a compact state of the sofa the seat cushion, the first arm panel, the second arm panel, the seat back, and the seat back cushion are disposed in the single packing box, wherein the seat cushion, the first arm panel, the second arm panel, the seat back, and the seat back cushion are not attached to one another in the compact state, and wherein the flap is attached to the seat cushion in an assembled state of the sofa, wherein in the assembled state a gap exists between a back edge of the seat cushion and a front side of the seat back, and wherein in the assembled state the flap extends substantially horizontally from an upper back edge of the seat cushion over the gap to the front side of the seat back and covers the gap below.

13. The boxed sofa of claim 12, wherein the seat back does not contact the seat cushion in the assembled state of the sofa.

14. The boxed sofa of claim 12, further comprising:

a zipper that attaches the flap to the seat cushion in the assembled state, and wherein the flap is not attached to the seat cushion in the compact state.

15. The boxed sofa of claim 12, wherein the seat back has a height, wherein the seat cushion has a depth, wherein the first arm panel has a height, and wherein the height of the seat back, the depth of the seat cushion and the height of the first arm panel are approximately equal.

16. The boxed sofa of claim 15, wherein the single packing box has a width that is slightly greater than the depth of the seat cushion.

17. The boxed sofa of claim 12, further comprising:

first legs that are attached to the first arm panel in the assembled state; and second legs that are attached to the second arm panel in the assembled state, wherein the first legs are not attached to the first arm panel in the compact state and the second legs are not attached to the second arm panel in the compact state, and wherein in the assembled state the seat back and the seat cushion are attached to both the first arm panel and the second arm panel.

18. The boxed sofa of claim 12, wherein the seat back cushion is disposed above the flap in the assembled state.

* * * * *